United States Patent [19]

Skinner et al.

[11] 4,254,699

[45] Mar. 10, 1981

[54] LIQUID-SOLID CONTACTING APPARATUS

[75] Inventors: Lawrence A. Skinner; Barney W. Hilton, both of Dallas, Tex.

[73] Assignee: Frito-Lay, Inc., Dallas, Tex.

[21] Appl. No.: 863,258

[22] Filed: Dec. 22, 1977

Related U.S. Application Data

[63] Continuation of Ser. No. 764,275, Jan. 31, 1977, abandoned.

[51] Int. Cl.[3] ..... B02B 1/04

[52] U.S. Cl. ..... 99/516; 366/307; 366/316

[58] Field of Search ..... 99/516, 534, 600, 609, 99/520, 522, 611, 518, 519, 524, 517, 521, 523, 535, 536; 134/153, 134; 366/315, 316, 317, 302, 307, 293

[56] References Cited

U.S. PATENT DOCUMENTS

| | | | |
|---|---|---|---|
| 510,769 | 12/1893 | Bodine | 99/522 |
| 623,668 | 4/1899 | Holt | 366/316 X |
| 806,397 | 12/1905 | Cornwall | 99/518 |
| 1,158,304 | 10/1915 | Schaub | 366/316 X |
| 2,734,728 | 2/1956 | Myers | 366/316 X |
| 3,062,627 | 11/1962 | Zuiderweg | 366/316 X |
| 3,194,664 | 7/1965 | Eytinge | 99/534 X |
| 3,222,038 | 12/1965 | Ashcraft | 366/316 X |
| 3,741,223 | 6/1973 | Kavera et al. | 99/534 X |

FOREIGN PATENT DOCUMENTS

| | | | |
|---|---|---|---|
| 907265 | 10/1962 | United Kingdom | 99/516 |

*Primary Examiner*—John M. Jillions
*Attorney, Agent, or Firm*—Bernard & Brown

[57] ABSTRACT

There is disclosed an apparatus for treating a downwardly moving, compact bed of solid particles by contact with a flooding liquid, e.g., corn solids are treated with an aqueous solution of lime. Means are provided to obtain relatively uniform, gravity flow of the compact solids through the bed to provide for relatively uniform treatment of the solids with the liquid.

43 Claims, 5 Drawing Figures

LIQUID-SOLID CONTACTING APPARATUS

This is a continuation of application Ser. No. 764,275, filed Jan. 31, 1977, now abandoned.

This invention relates to an apparatus for providing uniform contact of a downwardly moving, compact bed of particulate solids with a liquid which floods the bed. More particularly, the invention is concerned with an apparatus having means for insuring relatively uniform or plug, gravity flow of a compact bed of particulate solids through a vessel in which the solids are in contact with a liquid which floods the bed to fill the interstices between the solids over a substantial height of the vessel. The apparatus is especially useful in contacting the solids with a liquid treating agent in order that the solids passing through the vessel have a relatively uniform residence time in contact with the liquid thereby insuring that given portions of the solids will not be treated for materially greater or lesser times than desired. As an example, the treatment of corn solids with an aqueous solution of calcium hydroxide can be accomplished in a continuous manner in the apparatus of the invention at relatively uniform residence times. Such treatment facilitates the further processing of the corn without having to unduly adjust subsequent treating operations as might be required if the products withdrawn from the treating vessel were not subjected to relatively uniform treatment with the liquid.

In many processes it is desired to contact particulate solids with liquids for a given period of time in order to accomplish a desired chemical or physical modification of the solids. When large amounts of solids are to be treated it is most advantageous that they be disposed as a relatively compact bed in order to contain the solids in the smallest possible vessel and thereby save the considerable expense that the use of larger vessels would entail. In the compact bed it is desirable that there be little, if any, relative movement of the particles with respect to each other and in the type of treatment involved there is no need to provide agitation or intimate mixing of the liquid and solids since mere flooding of the bed with the treating liquid will suffice to accomplish the desired result.

These treatments of solids have most often been accomplished in the past merely by providing a number of soaking tanks in which the solids are placed and then flooded with the liquid treating agent. After a period of time the tanks are emptied and the operation repeated. This is a batch operation requiring a plurality of treating tanks, allotment of periods for loading and unloading, and excessive labor cost. It is most desirable to conduct the operation on a more continuous basis to reduce the vessel capacity required and lower operating expenses.

One approach to a more continuous type of treatment is to feed the solids into the top of a treating vessel containing the treating liquid and remove treated solids from the bottom, and in doing so it is desired that the solids be disposed as a compact, downwardly moving bed in order to be able to utilize a vessel of small capacity for the amount of solids to be processed. Although appearing quite simple, difficulties in this operation do, however, arise. Thus, in order to obtain a uniform length of contact between the solids and the treating liquid, any given solid particle should have approximately equal residence time in the liquid. To accomplish this goal the compact bed should move relatively uniformly downwardly through the vessel across substantially the entire cross-section of the vessel. This type of flow has often been characterized as plug flow and indicates the substantial absence of flow channels through the bed wherein some particles move faster than in other portions of the bed.

The apparatus of the present invention provides for relatively uniform downward movement by gravity of the compact bed of particulate solids through a treating vessel while in contact with a treating liquid which occupies or floods the vessel over a substantial portion of its height. The flooding liquid thus occupies the interstices between the solid particles which are in particle-to-particle contact substantially throughout the compact bed. Also, the movement of the bed through the vessel is sufficiently slow so that there is relatively little particle-to-particle movement or intermixing, and substantial channeling of particle flow through the bed is avoided. This operation is made possible by providing the vessel with especially designed means for controlling the addition of solids to the upper part of the bed and the flow of solids through or from the bed in the region of its lower portion.

The invention is particularly useful in treating grains with a liquid which serves to facilitate dehulling. For example, solids such as whole corn grains can be contacted with an aqueous solution of lime, at, for instance, temperatures of about 95° to 145° F. Suitable treating times include, for instance, about 8 to 16 hours or more.

The character and operation of the features of the present invention will become apparent from the description of an embodiment of the invention as represented in the drawings in which like parts are designated by like reference numerals. In the drawings.

Figure 1:
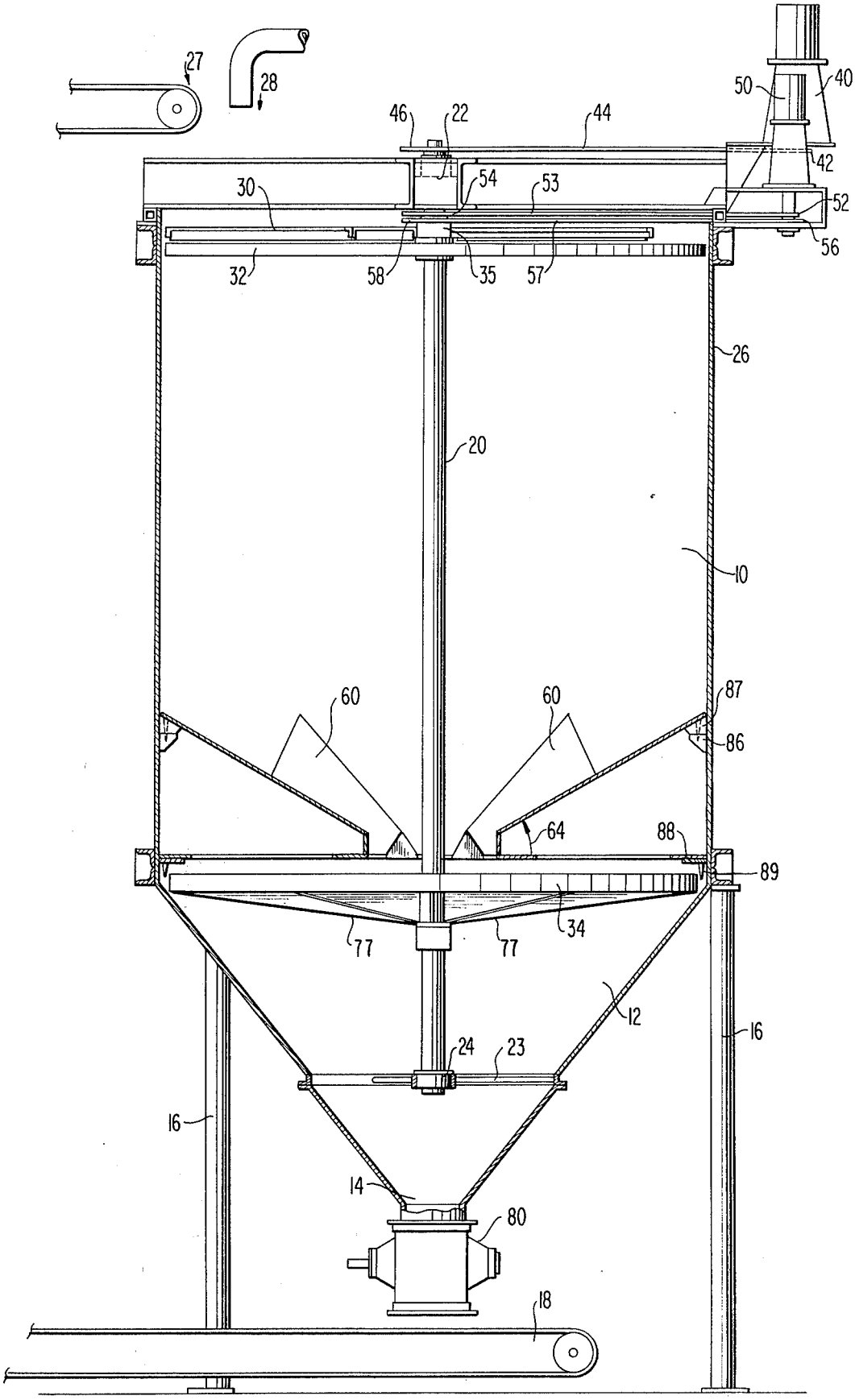
FIG. 1 is a cross-sectional, elevational view of a preferred embodiment of the apparatus in accordance with the present invention.

Tank 10 is a generally vertically-positioned vessel for treating a compact bed of solid particles by contact with a flooding liquid. Preferably, tank 10 is a generally circular vessel having an open upper end and a conical, downwardly-extending bottom portion 12. Bottom portion 12 has a centrally-located outlet 14 for the particulate solids which have passed through the vessel. As seen in FIG. 1, the tank is supported by members 16 on a floor or other suitable surface such that the outlet 14 is positioned so the particulate solids can be dispensed onto conveyor 18 for transporting them to subsequent processing operations.

Centrally located in tank 10 is a generally vertical shaft 20 suitably journalled for rotation at the upper end in drive assembly 22 and at the lower end in bearing 24 which is held by a web-type support 23 within bottom portion 12. Fixedly mounted on central shaft 20 and generally horizontally-disposed within tank 10 are one or more spreader arms 30, an upper rotatable disc 32 and a lower rotatable disc 34. Spreader arms 30 are mounted on hub 35 which is positioned immediately above upper disc 32 which is generally horizontally positioned, preferably, in the upper portion of the tank above the compact bed of solid particles. The solid particles to be treated are deposited on the top surface of upper disc 32 by a conveyor, elevator, or other dispensing means 27. Pipe 28 dispenses the liquid treating agent into the top of the vessel at a rate which will maintain the liquid level in the vessel so as to submerge at least a substantial portion, up to essentially all, of the compact bed of solid particles. The deposited solid particles are uniformly distributed over the surface of the upper disc 32 by spreader arms 30 and subsequently deposited on the upper surface of the compact bed of solids located between discs 32 and 34 by descending primarily through slot 66 of disc 32. Lower rotating disc 34 is generally horizontally positioned in the lower portion of tank 10, preferably near the point where bottom conical portion 12 is attached to the solid tank wall member 26. Lower disc 34 is fixedly mounted on central shaft 20 so as to be rotated by the shaft. Most of the compact bed is generally located between upper and lower rotatable discs 32 and 34, and the solid particles descend past disc 34 through discharge opening 70 in disc 34.

As depicted in FIG. 1, a power source such as an electric motor 40 is mounted on tank wall member 26 so as to drive sprocket 42. Drive chain 44 couples sprocket 42 and sprocket 46 which is fixedly mounted on central shaft 20 which rotates lower disc 34. A second power source such as an electric motor 50 with sprockets 52 and 56, is also mounted on tank member 26. Drive chain 53 couples sprocket 52 and sprocket 54 which is located in drive assembly 22 and thereby drives upper rotating disc 32. Similarly, drive chain 57 couples sprocket 56 with sprocket 58 which is located in drive assembly 22 and drives hub 35 and spreader arms 30. As indicated, the hub to which the spreader arms are attached and the upper rotating disc are rotatably mounted on central shaft 20. However, both upper rotating disc 32 and spreader arm assembly 35 should preferably be mounted on shaft 20 by a bearing system of suitable design located, for instance, in drive mechanism 22 so as to provide for their rotation independent of the rotation of central shaft 20. The speeds of rotation of spreader arms 30, upper disc 32, and lower disc 34 are determined by the speeds of motors 40 and 50 and the relative diameters of sprockets 42, 46, 52, 54, 56 and 58. Preferably, spreader arms 30 and the upper disc 32 should not rotate at the same speed if they are moving in the same direction, otherwise, the solid particles may not be spread evenly over the top surface of the upper disc. By spreading the particles over the upper disc a fairly constant amount can continuously pass through the disc, and thereby form a compact bed with a relatively smooth, generally horizontally-disposed upper surface. As depicted in FIG. 1, sprocket 56 is larger than sprocket 52 and sprockets 54 and 58 are approximately the same size. Thus, as sprockets 52 and 56 are rotated by power source 50, spreader arms 30 which are coupled to sprocket 56 will rotate more rapidly than upper disc 32 which is coupled to sprocket 52. Preferably, spreader arms 30 may rotate at about 150 to 300 rotations per hour (rph), upper rotating disc 32 at about 90 to 180 rph, and lower rotating disc 34 at about 10 to 60 rph. Alternatively, the spreader arms and the upper disc may be rotated in opposite directions. This may be accomplished by providing a third independent power source to which sprocket 56 would be fixedly mounted; sprocket 52 would then remain fixedly mounted to second power source 50, as previously described. In such case, the spreader arms may preferably rotate at about 90 to 180 rph, while the upper disc could preferably rotate in the opposite direction at about 90 to 130 rph.

Preferably, a plurality of baffles 60 are positioned in tank 10, most advantageously in the lower portion of the tank, e.g., more or less immediately above disc 34. Baffles 60 may be essentially uniformly disposed around shaft 20. As shown in the drawings a preferred form of the baffle is composed of side plates 61 and 63 whose upper ends meet to form an apex. The lower surfaces of the plates 61 and 63 are spread apart, and preferably they converge towards each other as they extend inwardly from the inner wall of tank member 26 towards the center of the vessel in order to maintain an approximately rectangular opening between adjacent baffles for the passage of solids downwardly therethrough. As shown, the inwardly extending portions of plates 61 and 63 terminate before reaching shaft 20 to provide a more or less open central passageway for the downward flow of solids. Baffles 60 can have the lower ends of plates 61 and 63 turned inwardly as at 65 and 67 and a rear bar 69 for connecting the lower ends of the plates and thereby provide structural strength and stability. Baffles 60 can be mounted on tank wall member 26 by inserting pins 87 and 89 of the baffle into support hangers 86 and 88 which are affixedly mounted on tank member 26. This design allows the baffles to be easily removed for cleaning and repair of the lower portions of the device.

The apex of adjoining plates 61 and 63 of baffles 60 extend inwardly from the inner periphery of the vessel and downwardly toward the lower disc. Generally, the apex of adjoining baffle plates may form an angle with the horizontal plane of the base of the baffles, as indicated by arrow 64, which is greater than the angle of repose of the solids therein. The apex of the baffles may meet to form an acute, downwardly opening angle of, for instance, about 60° to 90°. Preferably, one or more of the baffles are positioned in each quadrant of the cross-sectional area of the vessel. The baffles counter the rotational force which may be applied to the bed by the motion of bottom disc 34 which may, otherwise, cause uneven downward flow in the lower portion of the compact bed of solids.

Figure 2:
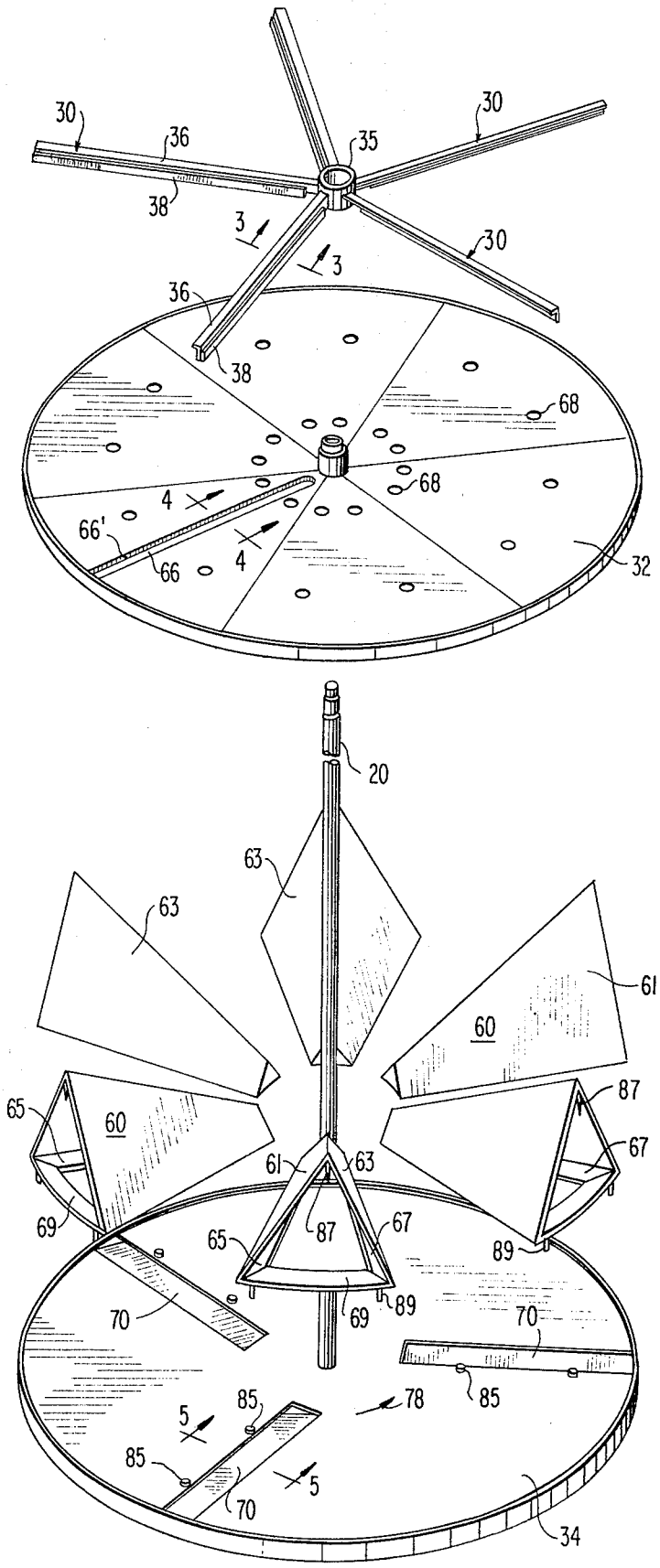
FIG. 2 is an exploded view of internal members of the apparatus of FIG. 1.

FIG. 2 shows the detail of an embodiment of the one or more spreader arms 30 which are generally horizontally-disposed and project radially outward from hub 35 and extend substantially along the entire radius of the vessel. Typically, a plurality of, e.g. five, such spreader arms may be attached approximately equally-spaced around hub 35. Advantageously, each spreader arm should extend outwardly and terminate just short of the inside wall of tank member 26, in order to maximize the rotational operation efficiency. That is to say, the spreader arms most advantageously smooth the upper surface of the solid particles deposited on disc 32 over as much of the upper cross-sectional area of the disc as is practical.

Figure 3:
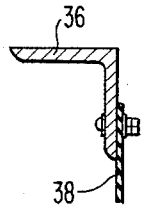
FIG. 3 is a fragmentary sectional view taken along line 3—3 of FIG. 2.

As illustrated in FIG. 3, each spreader arm 30 is preferably made of two pieces, i.e., the principal support bar 36 and a blade 38. Blade 38 is preferably made of neoprene or some other non-corrosive, lightweight, flexible material. When blade 38 is bolted or otherwise clamped to the support bar 36, it may extend downwardly and generally perpendicularly toward upper rotating disc 32. As the spreader arms rotate, the blade evenly spreads the solid particles which have been deposited on upper rotating disc 32, to form a generally flat, horizontal surface of solids. Blade 38 can be made of a lightweight flexible material so as to pass over the surface of the upper disc at a position only slightly thereabove, and yield to irregularities in the surface of upper disc 32 with which the blades may contact.

Figure 4:
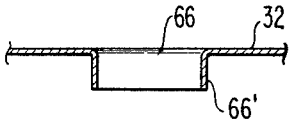
FIG. 4 is a fragmentary sectional view taken along line 4—4 of FIG. 2.

Upper rotating disc 32 is generally horizontally-disposed, and usually extends over substantially the entire cross-sectional area of the vessel. Preferably, the upper rotating disc should come close to making contact with the inside wall of tank member 26 so as to minimize passage of solid particulates between the outer peripheral edge of the disc and the inner periphery of tank member 26. Upper disc 32 has one or more radially-disposed, elongated openings 66 extending along a substantial portion of the radius of the disc. Opening 66 generally extends over a major portion up to substantially the entire radius of disc 32, and such openings usually comprise a minor portion of the total cross-sectional area of tank 10. FIG. 4 illustrates a preferred form of opening 66 in which there is provided a flange member 66' extending downwardly around the periphery of the opening to add strength to the slotted area of the disc. As the upper disc rotates, a relatively constant amount of solid particles may pass through opening 66 to form a generally horizontally-disposed upper surface on the compact bed of solids therebelow. Preferably, upper disc 32 may have a plurality of small openings 68 at, for instance, more or less regularly spaced intervals which provide means for removing the upper disc from the vessel to facilitate cleaning and repair. Additionally, these openings allow the liquid charged to the vessel to flow more freely through the upper disc, thereby assuring that the compact bed is flooded with the liquid solution. For convenience in manufacturing, disc 32 may be fabricated of a single piece or a plurality of sections which are securely attached together.

FIG. 2 also details the generally horizontally-disposed lower, rotatable disc 34 which is positioned below baffles 60. The lower disc extends from central shaft 20 radially outward over substantially the entire cross-sectional area of the vessel. As with upper disc 32, it is preferable for the lower disc to come close to making contact with the inside wall of tank member 26 to prevent undue passage of solid particulates around the outer peripheral edge of the disc. Since the lower disc supports the weight of the compact bed thereabove, it may be advisable to brace the disc as with radially-extending bars 77. Lower disc 34 is preferably positioned near the upper end of the conical bottom portion of the vessel 12.

Figure 5:
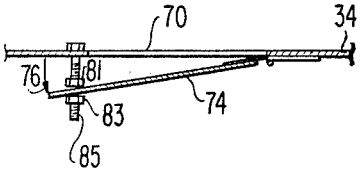
FIG. 5 is a fragmentary sectional view taken along line 5—5 of FIG. 2.

Lower disc 34 has one or more radially-disposed openings 70 which extend along a substantial portion of the radius of the disc, so that solid particles may pass relatively uniformly therethrough. Typically, the openings may extend along a major portion up to substantially the entire radius, and a plurality, e.g. three, of such openings may be located around shaft 20, preferably at regularly-spaced intervals. As depicted in FIG. 5 of the drawings, each of the openings 70 is an elongated slot having a door 74 therebeneath. The openings 70 may be rectangular in shape and their total cross-sectional area is generally a minor portion of the cross-sectional area of tank 10. The door 74 beneath each opening 70 is hingedly attached to disc 34 and is angled downward in an adjustable manner to form an acute angle, say of up to about 15°, preferably about 4° to 15°, with the lower surface of lower disc 34, as is indicated by arrow 76. Each door 74 should advantageously extend beneath substantially the whole area of its respective opening 70. Door 74 can be raised or lowered by appropriately adjusting nuts 81 and 83 on bolt 85 depending from disc 34. As a result, the angle 76 may be adjusted so as to achieve the desired rate of passage of solids through disc 34. This arrangement prevents the solid particles from passing too quickly through the lower disc, and the uniform, turbulent-free flow of the compact bed can be maintained.

Door 74 is preferably angled downwardly in the direction opposite to that of the rotation of lower disc 34, see arrow 78 in FIG. 2. Thus, each of the doors 74 is attached to lower disc 34 along the leading edge of the overlying opening 70 with respect to the direction of rotation of the lower disc. As the lower disc rotates, the solid particulates which pass through openings 70 will move downwardly through the openings and laterally and downwardly from the upper surface of doors 74. The solids which have previously passed through openings 70 may come in contact with the lower surface of the doors 74, but will not re-enter the space between openings 70 and their respective door 74 due to the direction of rotation of disc 34.

The solid particles having passed through lower disc 34, flow toward and through outlet 14 at the bottom of the vessel, for subsequent processing. Preferably, rotary feeder or release valve 80 may be used to control the amount of solids and liquid solution that can be released from outlet 14; thereby, maintaining a desired level of liquid solution and solids within the tank. Thus, rotary feeder 80 may be of the type that isolates a controlled and limited quantity of solids and liquid which quantity is removed from the lower vessel upon actuation of rotary feeder 80. The rotary feeder 80, however, seals the lower end of the vessel to the discharge of liquid or solids except by rotation of feeder 80. As a consequence, liquid and solids are prevented from discharging freely from the vessel.

Although the present invention has been described with reference to a preferred embodiment, alterations and rearrangements in the device can be made, and still the result would be within the scope of the invention.

It is claimed:

1. Apparatus providing movement of a bed of solid particles substantially uniformly therethrough in a downwardly direction, comprising:

(a) a generally vertically-disposed vessel for containing a compact bed of solid particles in contact with a liquid;

(b) a rotatable, generally horizontally-disposed lower disc means located substantially throughout the cross-sectional area of a lower portion of said vessel for supporting said bed, said lower disc means being vertically stationary with respect to said vessel and having one or more openings for passage of solids therethrough from said bed;

(c) a rotatable, generally horizontally-disposed, upper disc means located substantially throughout the cross-sectional area of an upper portion of said vessel, said upper disc means having one or more openings for passage of solids therethrough;

(d) means for rotating said upper and lower disc means;

(e) means independent of the rotation of said upper disc means for distributing said particulate solids over the upper surface of said upper disc means during rotation of said upper disc means;

(f) said vessel being constructed above said lower disc means to permit solids therein to move uniformly by gravity downwardly in said bed substantially throughout the horizontal cross-sectional area of said bed; and (g) means for discharging solid particles from the lower portion of said vessel while maintaining liquid in said bed above said lower disc means.

2. Apparatus as claimed in claim 1 wherein said means for rotating said upper and lower disc means comprises a generally vertically-disposed shaft means mounted for rotational movement in the central portion of said vessel.

3. Apparatus as claimed in claim 2 wherein said lower disc means, said upper disc means, and said distribution means are mounted on said shaft means.

4. Apparatus as claimed in claim 1 in which said distribution means comprises at least one spreader arm projecting radially from the central portion of said vessel and extending along substantially the entire radius of said vessel.

5. Apparatus as claimed in claim 4 in which said spreader arm further comprises a support bar and a depending blade, said blade being made of a flexible material.

6. Apparatus as claimed in claim 1 comprising means to rotate said upper disc means and said distribution means in the same direction and at different speeds of rotation to spread solid particles over the upper surface of said upper disc means.

7. Apparatus as claimed in claim 1 comprising means for maintaining liquid substantially throughout said bed of solid particles.

8. Apparatus as claimed in claim 1 comprising a plurality of generally vertically-disposed baffle means, said baffle means extending convergingly inwardly from the inner periphery of said vessel between said lower and upper disc means.

9. Apparatus as claimed in claim 8 wherein said baffle means are positioned immediately above said lower disc means.

10. Apparatus as claimed in claim 9 wherein at least one of said baffle means is positioned in each quadrant of said vessel.

11. Apparatus as claimed in claim 1 wherein said one or more openings in said lower disc means have means therebelow for restricting the flow of particulate solids through said openings.

12. Apparatus as claimed in claim 11 wherein said restricting means extends beneath substantially the whole area of its respective opening.

13. Apparatus as claimed in claim 12 wherein said one or more openings extend radially in said lower disc means, and said restricting means is attached to said lower disc means along the leading side of its respective opening with respect to the direction of rotation of said lower disc means, and said restricting means extends downwardly from said lower disc means.

14. Apparatus as claimed in claim 1 wherein a plurality of baffle means are positioned between said upper and lower disc means, said baffle means comprising opposed sides forming an apex at their upper ends, said apex extending downwardly towards the center of said vessel.

15. Apparatus as claimed in claim 14 wherein said baffle means are positioned immediately above said lower disc means and at least one of said baffle means is positioned in each quadrant of said vessel.

16. Apparatus as claimed in claim 15 wherein said sides of said baffle means extend convergingly inwardly in said vessel.

17. Apparatus providing movement of a bed of solid particles uniformly therethrough in a downwardly direction, comprising:

(a) a generally circular, vertically-disposed vessel for containing a compact bed of solid particles, said vessel having a conical downwardly-extending bottom with a centrally-located outlet in a lower portion of said vessel, said outlet having means for restricting the free flow of solid particles and liquid therethrough;

(b) a generally vertically-disposed shaft means mounted for rotational movement in the central portion of said vessel;

(c) a rotatable, generally horizontally-disposed lower disc means located substantially throughout the cross-sectional area of a lower portion of said vessel for supporting said bed and mounted for rotation with said shaft means without substantial vertical movement;

(d) one or more radially-disposed openings in said lower disc means for passage of particulate solids therethrough, said openings having plate means therebelow for restricting the flow of solids through said openings;

(e) a rotatable, generally horizontally-disposed, upper disc means located substantially throughout the cross-sectional area of an upper portion of said vessel and mounted for rotation with said shaft means, said upper disc means having one or more radially-disposed openings for passage of solids therethrough;

(f) means for rotating said shaft means;

(g) a plurality of generally vertically-disposed baffle means between said lower and upper disc means for countering the rotational force imparted to said bed of solid particles by said bottom disc means, said baffle means extending convergingly inwardly from the inner periphery of said vessel; and (h) means for distributing said particulate solids over the upper surface of said upper disc means during rotation of said upper disc means.

18. Apparatus as claimed in claim 17 wherein said plate means extends beneath substantially the whole area of its respective opening, said plate means is attached to said lower disc means along the leading side of its respective opening with respect to the direction of rotation of said lower disc means, and said plate means extends downwardly from said lower disc means.

19. Apparatus as claimed in claim 17 wherein said baffle means comprise opposed sides forming an apex at their upper ends, said apex extending downwardly towards the center of said vessel.

20. Apparatus as claimed in claim 18 wherein said baffle means comprise opposed sides forming an apex at their upper ends, said apex extending downwardly towards the center of said vessel.

21. Apparatus as claimed in claim 20 wherein said baffle means are positioned immediately above said lower disc means and at least one of said baffle means is positioned in each quadrant of said vessel.

22. Apparatus providing movement of a bed of solid particles substantially uniformly therethrough in a downwardly direction, comprising:

(a) a generally vertically-disposed vessel for containing a compact bed of solid particles;

(b) a rotatable, generally horizontally-disposed lower disc means located substantially throughout the cross-sectional area of a lower portion of said vessel for supporting said bed, said lower disc means being vertically-stationary with respect to said vessel and having one or more openings for passage of solids therethrough from said bed;

(c) a rotatable, generally horizontally-disposed, upper disc means located substantially throughout the cross-sectional area of an upper portion of said vessel, said upper disc means having one or more openings for passage of solids therethrough;

(d) means for rotating said upper and lower disc means;

(e) means independent of the rotation of said upper disc means for distributing said particulate solids over the upper surface of said upper disc means during rotation of said upper disc means;

(f) a plurality of generally vertically-disposed baffle means, said baffle means extending convergingly inwardly from the inner periphery of said vessel between said lower and upper disc means, wherein said baffle means are positioned immediately above said lower disc means;

(g) wherein at least one of said baffle means is positioned in each guadrant of said vessel; and (h) means for maintaining liquid in said vessel above said lower disc means.

23. Apparatus providing movement of a bed of solid particles substantially uniformly therethrough in a downwardly direction, comprising:

(a) a generally vertically-disposed vessel for containing a compact bed of solid particles;

(b) a rotatable, generally horizontally-disposed lower disc means located substantially throughout the cross-sectional area of a lower portion of said vessel for supporting said bed, said lower disc means being vertically-stationary with respect to said vessel and having one or more openings for passage of solids therethrough from said bed;

(c) a rotatable, generally horizontally-disposed, upper disc means located substantially throughout the cross-sectional area of an upper portion of said vessel, said upper disc means having one or more openings for passage of solids therethrough;

(d) means for rotating said upper and lower disc means;

(e) means independent of the rotation of said upper disc means for distributing said particulate solids over the upper surface of said upper disc means during rotation of said upper disc means; and (f) a plurality of baffle means are positioned between said upper and lower disc means, said baffle means comprising opposed sides forming an apex at their upper ends, said apex extending downwardly towards the center of said vessel.

24. Apparatus as claimed in claim 23 wherein said baffle means are positioned immediately above said lower disc means and at least one of said baffle means is positioned in each quadrant of said vessel.

25. Apparatus as claimed in claim 24 wherein said sides of said baffle means extend convergingly inwardly in said vessel.

26. Apparatus providing movement of a bed of solid particles uniformly therethrough in a downwardly direction, comprising:

(a) a generally circular, vertically-disposed vessel for containing a compact bed of solid particles, said vessel having a conical downwardly-extending bottom with a centrally-located outlet in a lower portion of said vessel, said outlet having means for restricting the free flow of solid particles and liquid therethrough;

(b) a generally vertically-disposed shaft means mounted for rotational movement in the central portion of said vessel;

(c) a rotatable, generally horizontally-disposed lower disc means located substantially throughout the cross-sectional area of a lower portion of said vessel for supporting said bed and mounted for rotation with said shaft means and said lower disc means being vertically-stationary with respect to said vessel;

(d) one or more radially-disposed openings in said lower disc means for passage of particulate solids therethrough, plate means extending below said openings for controlling the flow of solids through said openings;

(e) a rotatable, generally horizontally-disposed, upper disc means located substantially throughout the cross-sectional area of an upper portion of said vessel and mounted for rotation with said shaft means, said upper disc means having one or more radially-disposed openings for passage of solids therethrough;

(f) means for rotating said shaft means;

(g) a plurality of generally vertically-disposed baffle means, between said lower and upper disc means, said baffle means extending convergingly inwardly from the inner periphery of said vessel;

(h) means independent of the rotation of said upper disc means for distributing said particulate solids over the upper surface of said upper disc means during rotation of said upper disc means; and (i) said baffle means comprise opposed sides forming an apex at their upper ends, said apex extending downwardly towards the center of said vessel.

27. Apparatus as claimed in claim 26 wherein said plate means extends beneath substantially the whole area of its respective opening, said plate means is attached to said lower disc means along the leading side of its respective opening with respect to the direction of rotation of said lower disc means, and said plate means extends downwardly from said lower disc means.

28. Apparatus as claimed in claim 27 wherein said baffle means are positioned immediately above said lower disc means and at least one of said baffle means is positioned in each quadrant of said vessel.

29. Apparatus providing movement of a bed of solid particles substantially uniformly therethrough in a downwardly direction, comprising:

(a) a generally vertically-disposed vessel for containing a compact bed of solid particles;

(b) a rotatable, generally horizontally-disposed lower disc means for supporting said bed of solid particles, said disc extending substantially throughout the cross-sectional area of the lower portion of said vessel for containing said bed, said lower disc means being vertically-stationary with respect to said vessel and having one or more openings for passage of solids therethrough;

(c) means for rotating said lower disc means;

(d) a plurality of vertically-extending means in spaced-apart relationship in the lower portion of said bed vessel and above said lower disc means to permit solid particles to move downwardly in said vessel between said vertically-extending means;

(e) said vessel being constructed above said vertically-extending means to permit solids therein to move uniformly by gravity downwardly in said bed substantially throughout the horizontal cross-sectional area of said bed; and (f) means to maintain liquid in said vessel above said lower disc means.

30. Apparatus providing movement of a bed of solid particles substantially uniformly therethrough in a downwardly direction, comprising:

(a) a generally vertically-disposed vessel for containing a compact bed of solid particles;

(b) a rotatable, generally horizontally-disposed lower disc means located substantially throughout the cross-sectional area of a lower portion of said vessel for supporting said bed, said lower disc means being vertically-stationary with respect to said vessel and having one or more openings for passage of solids therethrough;

(c) a rotatable, generally horizontally-disposed, upper disc means located substantially throughout the cross-sectional area of an upper portion of said vessel, said upper disc means having one or more openings for passage of solids therethrough;

(d) means for rotating said upper and lower disc means;

(e) said vessel being constructed above said lower-disc means to permit solids therein to move uniformly by gravity downwardly in said bed substantially throughout the horizontal cross-sectional area of said bed;

(f) means for maintaining liquid in said vessel to a substantial height above said lower disc means; and (g) means for discharging solid particles from the lower portion of said vessel.

31. Apparatus as claimed in claim 1, 29 or 30 in which said lower disc means has flow-deflecting means extending across but spaced vertically away from said one or more openings in said lower disc means.

32. Apparatus for providing movement of a bed of solid particles substantially uniformly therethrough in a downwardly direction in contact with liquid comprising:

(a) a generally vertically-disposed vessel for containing a compact bed of solid particles in contact with liquid;

(b) a rotatable, generally horizontally-disposed lower disc means, said lower disc means extending substantially throughout the cross-sectional areas of a lower portion of said bed for supporting said bed, said lower disc means having one or more openings for passage of solids therethrough from said bed; said one or more openings extending at least substantially between the axis and periphery of said disc means;

(c) means associated with said lower disc means for controlling the passage of solid particles from said bed through said one or more openings in said lower disc means for substantially uniform downward gravity flow of said solids in said vessel as a compact bed across substantially the entire cross-sectional area of the bed;

(d) means for rotating said lower disc means;

(e) means for counteracting rotational movement of said bed by said lower disc means; and (f) means for maintaining liquid in said vessel to a substantial height above said lower disc means.

33. The apparatus according to claim 32 having means for discharging solid particles from the lower portion of said vessel while maintaining liquid in said bed.

34. The apparatus according to claim 32 or 33 having means for distributing said solids generally uniformly over the upper part of the bed of solid particles.

35. The apparatus according to claim 32 or 33 wherein said means (c) extends below said lower disc means and is located adjacent said one or more openings for directing said solid particles passed through said one or more openings during rotation of said lower disc means.

36. Apparatus for providing movement of a bed of solid particles substantially uniformly therethrough in a downwardly direction in contact with liquid comprising:

(a) a generally vertically-disposed vessel for containing a compact bed of solid particles in contact with liquid;

(b) a rotatable, generally horizontally-disposed lower disc means, said lower disc means extending substantially throughout the cross-sectional area of a lower portion of said bed for supporting said bed, said lower disc means having one or more openings for passage of solids therethrough from said bed; said one or more openings extending substantially from the axis to the outer periphery of said disc means;

(c) means associated with said lower disc means for controlling the passage of solid particles from said bed through said one or more openings in said lower disc means for substantially uniform downward gravity flow of said solids in said vessel as a compact bed across substantially the entire cross-sectional area of the bed;

(d) means for rotating said lower disc means;

(e) means for maintaining liquid in said vessel to a substantial height above said lower disc means; and (f) means for discharging solid particles from the lower portion of said vessel while maintaining liquid in said bed.

37. The apparatus according to claim 36 having means above said lower disc means for counteracting rotational movement of said bed by said lower disc means.

38. The apparatus according to claim 36 or 37 having means for distributing said solids generally uniformly over the upper part of the bed of solid particles.

39. Apparatus for providing movement of a bed of solid particles substantially uniformly therethrough in a downwardly direction in contact with liquid comprising:

(a) a generally vertically-disposed vessel for containing a compact bed of solid particles in contact with liquid;

(b) a rotatable, generally horizontally-disposed lower disc means, said lower disc means extending substantially throughout the cross-sectional area of a lower portion of said bed for supporting said bed, said lower disc means having one or more openings for passage of solids therethrough from said bed; said one or more openings extending at least substantially between the axis and periphery of said disc means;

(c) means associated with said lower disc means for controlling the passage of solid particles from said bed through said one or more openings in said lower disc means for substantially uniform downward gravity flow of said solids in said vessel as a compact bed across substantially the entire cross-sectional area of the bed;

(d) means for rotating said lower disc means;

(e) arotatable, generally horizontally-disposed upper disc means extending substantially throughout the cross-sectional area of an upper portion of said vessel having one or more openings for passage of solids to said bed;

(f) means for maintaining liquid in said vessel to a substantial height above said lower disc means.

40. The apparatus according to claim 39 having means for discharging solid particles from the lower portion of said vessel while maintaining liquid in said bed.

41. The apparatus according to claim 39 or 40 having means for distributing said solids generally uniformly over said upper disk means.

42. Apparatus for providing movement of a bed of solid particles substantially uniformly therethrough in a downwardly direction in contact with liquid comprising:

(a) a generally vertically-disposed vessel for containing a compact bed of solid particles;

(b) a rotatable, generally horizontally-disposed lower disc means, said lower disc means extending substantially throughout the cross-sectional area of a lower portion of said bed for supporting said bed, said lower disc means having one or more openings for passage of solids therethrough from said bed; said one or more openings extending at least substantially between the axis and periphery of said disc means;

(c) means associated with said lower disc means for controlling the passage of solid particles from said bed through said one or more openings in said lower disc means for substantially uniform downward gravity flow of said solids in said vessel as a compact bed across substantially the entire cross-sectional area of the bed;

(d) means for rotating said lower disc means;

(e) means in the lower portion of said vessel and above said lower disc means for counteracting rotational movement of said bed by said lower disc means; and (f) means for discharging solid particles from the lower portion of said vessel while maintaining liquid in said bed.

43. The apparatus according to claim 42 having means for distributing said solids generally uniformly over the upper part of the bed of solid particles.

* * * * *

UNITED STATES PATENT OFFICE

CERTIFICATE OF CORRECTION

Patent No. 4,254,699 Dated March 10, 1981

Inventor(s) Lawrence A. Skinner and Barney W. Hilton

It is certified that error appears in the above-identified patent and that said Letters Patent are hereby corrected as shown below:

Column 4, line 2, "130" should be --180--.

Column 10, line 64, delete the word "bed".

Column 11, line 48, "areas" should be --area--.

Signed and Sealed this

*Second* Day of *June 1981*

[SEAL]

*Attest:*

RENE D. TEGTMEYER

*Attesting Officer*

*Acting Commissioner of Patents and Trademarks*